United States Patent [19]

Mutschler et al.

[11] 4,210,513

[45] Jul. 1, 1980

[54] PNEUMATIC ANODE POSITIONING SYSTEM

[75] Inventors: Thomas A. Mutschler; Gary J. Zimmerman, both of New Kensington, Pa.

[73] Assignee: Aluminum Company of America, Pittsburgh, Pa.

[21] Appl. No.: 957,302

[22] Filed: Nov. 2, 1978

[51] Int. Cl.[2] ..... C25C 3/10; C25C 3/20

[52] U.S. Cl. ..... 204/225; 204/245

[58] Field of Search ..... 204/225, 243 R, 244–247

[56] References Cited

U.S. PATENT DOCUMENTS

| | | | |
|---|---|---|---|
| 3,245,898 | 4/1966 | Wunderli | 204/225 |
| 3,390,070 | 6/1968 | Cooper et al. | 204/225 X |
| 3,960,694 | 6/1976 | Champion et al. | 204/225 X |
| 3,994,797 | 11/1976 | Smith | 204/225 |

*Primary Examiner*—L. Dewayne Rutledge
*Assistant Examiner*—D. R. Valentine
*Attorney, Agent, or Firm*—Patrick J. Viccaro

[57] ABSTRACT

A pneumatic anode positioning apparatus is disclosed for positioning any number of a plurality of anodes relative to a cathode in an electrolytic cell. This apparatus comprises a means for determining the desired anode position for each of the anodes and converting the amount of movement necessary to attain such position to a number of increments of predetermined displacement. The apparatus has a pneumatic, bidirectional drive means for incrementally rotating a substantially horizontally disposed shaft, a plurality of vertically disposed jack screws each connected to an anode or anodes and provided with means therebetween for changing incremental rotary motion to incremental, vertically longitudinal anode motion, a plurality of worm gears connected at their outer periphery to the shaft and at their inner periphery to an actuator nut disposed concentrically about a top portion of the jack screw, and pneumatic means for selectively engaging each actuator nut to its respective jack screw to rotate the jack screw incrementally in response to the incremental rotary movement of the shaft, the engaging means being responsive to the means for determining the desired anode position.

6 Claims, 2 Drawing Figures

PNEUMATIC ANODE POSITIONING SYSTEM

BACKGROUND OF THE INVENTION

1. Field of Invention

The present invention pertains to a pneumatic positioning system and more particularly to an improved pneumatic device for incrementally, simultaneously positioning any number of a plurality of anodes relative to a cathode in an electrolytic cell.

2. Description of the Prior Art

Electrolytic cells or pots, such as those used in the production of aluminum, basically consist of a carbon lined steel tank or vessel containing molten cryolite in which alumina is dissolved. Metallic aluminum is separated from the oxide (alumina) by passing an electric current through the solution at a temperature of approximately 970° C. (1775° F.). A plurality of carbon electrodes or anodes, typically 16 in number, are suspended above each electrolytic pot. The depth of immersion of the anode in the electrolyte is adjustable and should be carefully controlled. Usually, the anodes extend into the bath to within about two inches of the molten metal. Direct current is led into the electrolyte through the anodes and out through cathodic collector bars embedded in the carbon lining of the cell.

In the reduction process, the electrolyte is maintained in a molten state and at a proper temperature by the heating action of the electric current passing therethrough from the anodes to the cathode. The actual anodecathode distance should be frequently monitored and adjusted to maintain the desired bath temperature of about 960° to 980° C. (1760° to 1796° F.) during the process. Sufficient heat is lost at the surface of the electrolyte such that a frozen insulating crust, usually from one to two inches thick, forms at the top of the bath and around the anodes.

As the aluminum is electrolytically separated, oxygen is liberated at the carbon anode where it forms carbon dioxide while consuming the carbon anodes. As the carbon anodes are consumed, molten metal builds up in the bottom of the pot and the anodes must be adjusted periodically to assure a narrow spacing which maintains the voltage close to the decomposition voltage of the electrolyte. Proper frequent adjustment of the anode position increases the efficiency of the electrolytic pot resulting in increasing production, reducing electricity requirements per pound of metal, reducing the rate of consumption of carbon anodes and reducing the possibility of short circuiting with associated problems.

To illustrate the present electrical inefficiency, a current of 1,000 amps should deposit approximately 0.74 pounds (0.34 kg) of aluminum per hour at 100% current efficiency. For various reasons, the best commercial current efficiency is about 90%. The theoretical voltage required for the decomposition of the alumina with a carbon anode is a little less than two volts; the actual voltage of the cell terminals is 4.5 to 7.0 volts. One way to reduce this inefficiency is to substantially continuously monitor and maintain a more accurate anode-cathode distance.

Electric motors such as those disclosed in U.S. Pat. No. 3,844,913 are presently used to position anodes. It has been found that the response of the present electric motors to a signal is highly variable in part because of the varying resistance to anode movement imparted by the frozen bath crust which has formed around the anode in the reduction pot. This crust can impart a load in excess of 10,000 pounds on an individual anode and cause the motor to stall or become overloaded. To illustrate further, in a computerized reduction system, such as those disclosed in U.S. Pat. Nos. 3,627,666 and 3,900,373, each anode in the pot line may be consecutively surveyed to determine its proper position. The survey may determine that a specific anode should now be lowered 0.120 inch (0.30 cm). If the electric motor takes 1.0 second to move the anode 0.040 inch (0.10 cm), a 3.0 second timed pulse is sent to the electric motor. Under ideal conditions the anode would be lowered 0.120 inch (0.30 cm), and the computer would record this adjustment accordingly. However, in actual operation the crust may have imparted such a load on the anode that a 3.0 second timed pulse sent to the motor caused the anode to be lowered less than 0.120 inch (0.30 cm), or possibly not be lowered at all. Therefore, although the proper position of the anode is accurately determined, and the correct time pulse is sent to the electric jack motor, there is no assurance that the anode has responded accordingly. With electric motors, the anode-cathode distance is often inaccurately adjusted, and this error is not discovered until that specific anode is surveyed again, whereupon the anode may repeatedly be inaccurately positioned.

Also, there is an inherent safety hazard associated with the operation of three-phase alternating current induction motors installed in a smelting pot which may be a potential from zero to almost 1,000 direct current volts relative to ground potential. This two voltage level condition creates a risk of injury or death to the operators and to those working in the vicinity of the cell.

The anode positioning device disclosed in U.S. Pat. No. 4,039,419 is a substitute for the electric motor driven devices of the prior art. With such device each individual anode is provided with a piston-cylinder drive means.

A rack and pinion device for positioning anodes in an electrolytic cell is disclosed in U.S. Pat. No. 3,245,898. In this device the anodes are connected to a rack through a plate, and the rack is driven by its connection to a pinion carried on a motor driven shaft.

Accordingly, an improved system is required for selectively positioning any number of a plurality of anodes in an electrolytic cell that is pneumatically operated by a single, incremental drive means for all of the anodes and assures that anodes accurately respond to incremental positioning movements when engaged with the driving mechanism.

SUMMARY OF THE INVENTION

This invention may be summarized as providing a pneumatic anode positioning apparatus for positioning any number of a plurality of anodes relative to a cathode in an electrolytic cell. This apparatus comprises a means for determining the desired anode position for each of the anodes and converting the amount of movement necessary to attain such position to a number of increments of predetermined displacement. The apparatus has a pneumatic, bidirectional drive means for incrementally rotating a substantially horizontally disposed shaft, a plurality of vertically disposed jack screws, each connected to an anode or anodes and provided with means therebetween for changing incremental rotary motion to incremental, vertically longitudinal anode motion, a plurality of worm gears connected at their outer periphery to the shaft and at their inner periphery to an actuator nut disposed concentrically about a top portion of the jack screw, and pneumatic means for selectively engaging each actuator nut to its respective jack screw to rotate the jack screw incrementally in response to the incremental rotary movement of the shaft, the engaging means being responsive to the means for determining the desired anode position.

Among the advantages of the present invention is the provision of a positioning system for any number of a plurality of anodes in an electrolytic cell which is operated by a single drive means for all of the anodes.

Another advantage of the subject invention is that the positioning apparatus is operated by a pneumatic system, thereby eliminating the hazard due to two levels of voltage in an electrolytic cell.

An objective of the present invention is to provide a positioning system wherein the anodes engaged to the single driving mechanism accurately respond to incremental positioning commands to insure that the desired anode-cathode distance is maintained at each anode location.

A further advantage of the present invention is that the apparatus can be readily installed onto existing electrolytic cells without requiring extensive modification to existing capital equipment.

It follows that the pneumatic positioning device of this invention, when utilized to position anodes in an electrolytic cell, will result in less maintenance, more efficient positioning and, therefore, a more economically efficient and productive operation.

The above and other objectives and advantages of this invention will be more fully understood and appreciated with reference to the following description and the drawings appended hereto.

DESCRIPTION OF THE PREFERRED EMBODIMENTS

Figure 1:
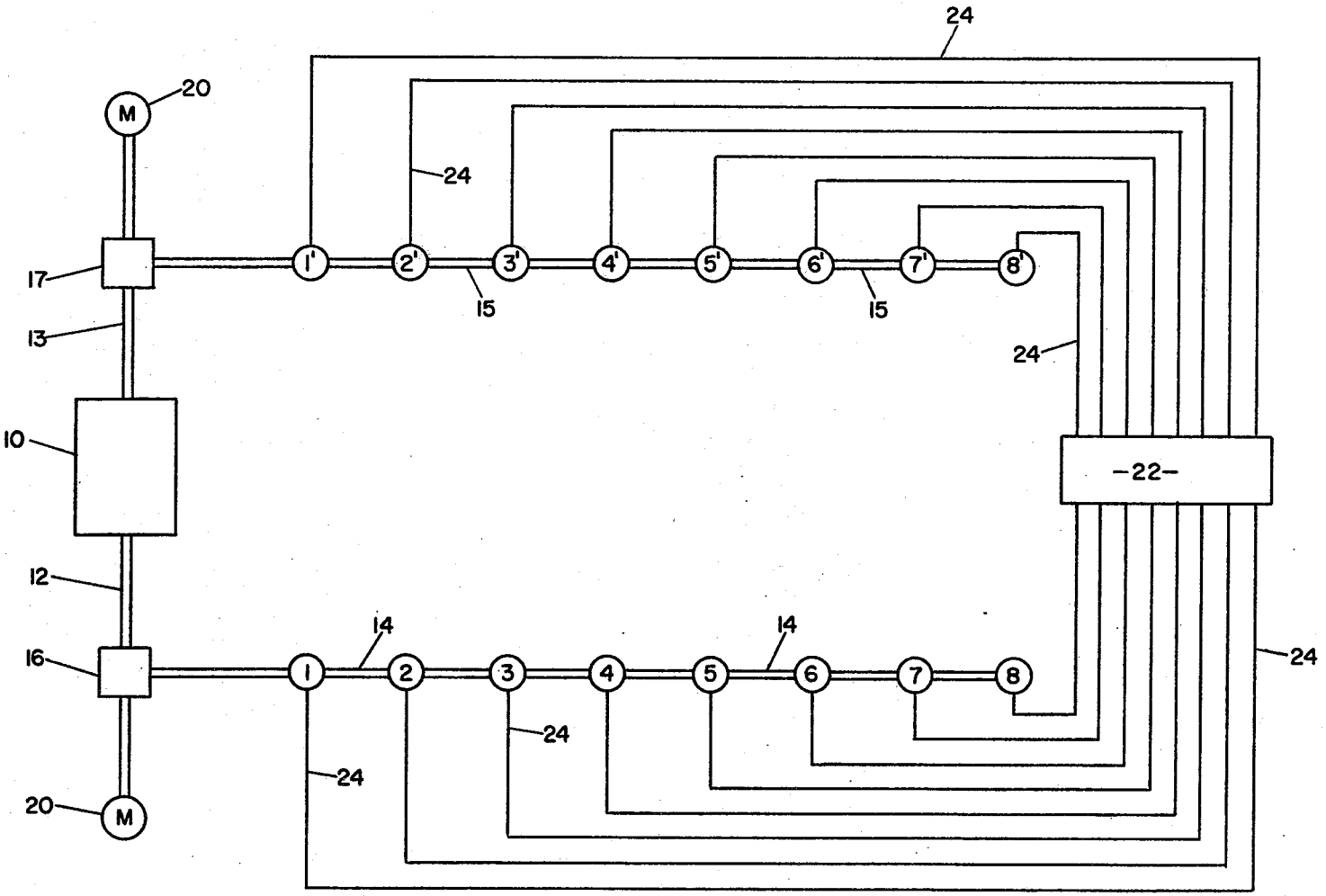
FIG. 1 is a diagrammatic illustration of the positioning apparatus of the present invention.

FIG. 1 illustrates diagrammatically the positioning apparatus of the present invention. The apparatus includes a driving mechanism 10 for incrementally rotating a shaft 12 and 13. The driving mechanism is not electrically operated, rather the mechanism is preferably a pneumatic ratchet type drive system. The pneumatic drive should be bidirectional, i.e., able to rotate selectively the shaft 12 and 13 integrally connected thereto in either direction. In a preferred embodiment, the drive system should incrementally rotate the shaft 12 and 13 along an angle of 120 degrees with each cycle. Thus, at a speed of zero to 120 cycles per minute, the shaft 12 and 13 would be turned at a rate of zero to 40 rotations per minute. It will be understood by those skilled in the art that any uniform drive cycle and rate of rotation may be utilized and adapted to the positioning apparatus of the present invention provided anode movements can be accurately measured as will be explained in more detail below.

It should be understood that the drive mechanism 10 may provide the power necessary to raise or lower many or all of a plurality of anodes, 1 through 8 and 1' through 8', simultaneously. Therefore, the drive mechanism 10 should exhibit an output torque able to overcome the overall load exhibited by all of the anodes. The available output torque for each anode is preferably at least approximately 300 inch pounds.

In a preferred embodiment of the anode positioning apparatus, the drive mechanism 10 is centrally located at one end of a generally rectangular electrolysis cell. Such cells are typically provided with multiple pairs of anodes. In the embodiment illustrated in FIG. 1, eight pairs or 16 anodes are provided with eight anodes located near the periphery of each side of the cell and extending, equally spaced from each other, to form two anode rows along each longitudinal side of the cell. The drive shaft 12 and 13 extending from such centrally located drive mechanism 10 is integrally connected through miter gear boxes 16 and 17 to drive shaft sections 14 and 15, which are disposed along each respective row of anodes. Those skilled in the art will understand that the drive mechanism 10 could be located at various positions on an electrolysis cell as long as its cyclic operation transmits positive, constant, incremental rotation of the shaft from the drive mechanism to each anode location. It is important that the amount of incremental rotation of the shaft at one anode location equal the amount of incremental rotation of the shaft at every other anode location to maximize precision anode position control. The shafts of the present invention must be constructed of sufficient strength and arranged such that the actual amount of torsion, bending, axial tension and compression do not adversely affect the accuracy of the positioning system. It has been found that solid steel shafts, hexagonal in cross section, 1⅛ inch (2.86 cm) as measured across the flat, are of adequate strength to transfer incremental rotary motion to the anodes of a conventional electrolytic cell for the production of aluminum.

The shaft sections 14 and 15 that are disposed along each row of anodes are integrally connected to the individual anodes through a gear and jack assembly. Such connection is made along a top portion of an electrolysis cell at the intersection of the shaft 14 with a top portion of an anode rod for each anode location. The screw mechanism and connection may be arranged within a protective housing as illustrated in detail in FIG. 2. Housing 18 is typically provided about the connections of the apparatus of the present invention to shield and protect the parts from the ambient heat which may exceed 300° F. (149° C.) and from the abrasive alumina dust found abundantly around electrolytic cells.

Figure 2:
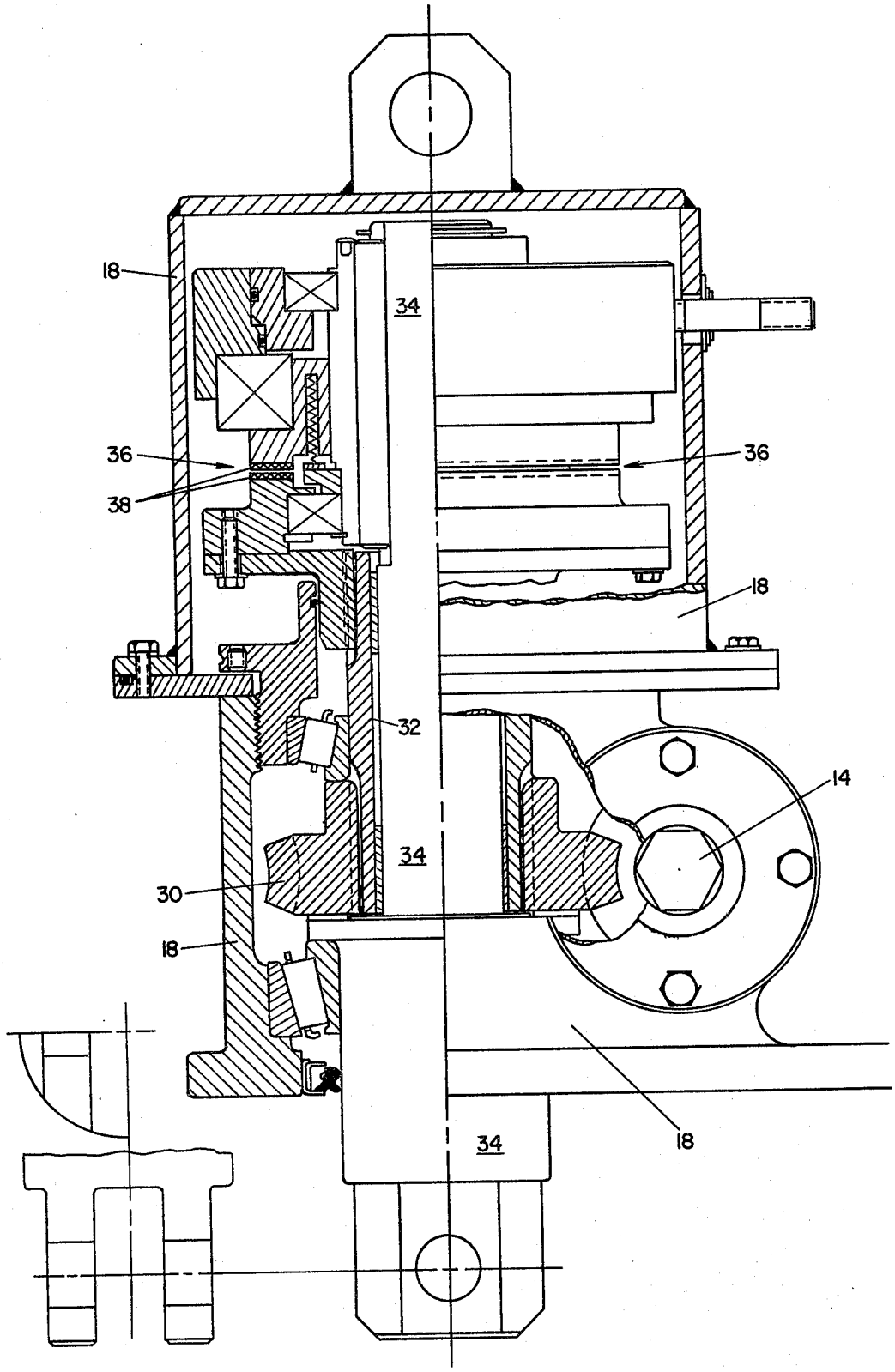
FIG. 2 is a side elevation view of the jack assembly of the present invention in partial cross section.

As shown in FIG. 2, the drive shaft 14 is integrally connected through gearing means to the outer peripheral surface of worm gear 30. The worm gear 30 is integrally connected at its inner periphery to an actuator nut 32. The actuator nut 32 is disposed concentrically about a top portion of a jack screw 34. The worm gear 30 transfers the incremental rotary motion of the generally horizontally disposed shaft 14 to incremental rotary motion of the generally vertically disposed actuator nut 32, which makes an angle of 90° with shaft 14. Typically, a gear reduction is designed into the positioning system. For example, with a gear ratio of 6:1, a 120° incremental rotation of shaft 14 or 15 would rotate the actuator nut only 20°, but the input torque of 300 inch pounds would be converted to an output torque of 1,800 inch pounds by such arrangement.

Integral connections between the shaft 14 and the worm gear 30, as well as between the worm gea 30 and the actuator nut 32, insures responsive movement of all these parts with each cycle of the drive mechanism as shaft 14 rotates. However, such motion does not cause the jack screw 34 to rotate unless the actuator nut 32 is selectively engaged to the jack screw 34. Preferably, pneumatic means (not shown) are used to operate the positioning device. In the embodiment illustrated in FIG. 2, a pneumatic clutch 36 is provided about a top portion of the jack screw 34. When it is desired to engage the jack screw 34, the clutch is pressurized with sufficient pressure to engage the teeth 38 on the face of each clutch plate. When the teeth are engaged, the jack screw 34 is fully responsive to incremental cyclic movements of drive mechanism 10.

In the operation of an automated electrolysis cell, the proper or optimum position of each anode in the cell is substantially continuously determined by any of conventional means. The actual position of each anode is available through continuous monitoring or measuring. The actual anode position is compared with the optimum anode position and an initial determination is made whether the anode should remain stationary, be raised or be lowered. This signal is transmitted to the drive mechanism 10 which operates to rotate the drive shaft in either direction. Rotation in one direction transmits the motion that raises an engaged anode while rotation in the other direction transmits the motion that lowers an engaged anode. It is understandable that a variety of determinations may be made for an individual cell. For example, anodes 1, 4 and 5 may need raised while anodes 2 and 6 need lowered. Preferably, a priority system must be programmed into the automated cell for the most efficient operation.

Once the determination of raising or lowering of an anode is transmitted to the drive mechanism 10, the pneumatic drive 10 begins to operate to incrementally rotate the shaft sections 12, 13, 14 and 15 in the desired direction. Substantially simultaneously with the operation of the drive mechanism 10, the clutches 36 for the anodes to be repositioned are engaged. The clutches 36 for the anodes that do not require repositioning at such time or in such direction are not engaged. Clutch engagement is preferably accomplished by a pneumatically operated engaging control 22 which is connected to each anode through individual air lines 24.

In addition to determining the direction that an anode is to be moved, the vertical distance that the anode is to be moved is also calculated. Such distance is automatically converted to a number of incremental movements or cycles of predetermined displacement necessary to move an engaged anode to its optimum position. In a preferred embodiment, the drive mechanism rotates the shaft to provide rotary displacement of 120 degrees per cycle and be operated at a speed of zero to 120 cycles per minute. Depending on design particulars, each cycle preferably results in constant incremental movement of engaged anodes within a range of linear displacement of from 0.010 to 0.050 inch. It will be understood that the incremental vertical displacement of the anode depends upon many variables including speed reduction or increase through gears, as well as spacing, pitch and helix angle of jack screw threads. Regardless of the incremental movement, the integral connections between the parts of the positioning apparatus of the present invention insures that all engaged anodes move in response to the incremental drive, and that such incremental movements are constant for each engaged anode and with each repetitive cycle.

Since the constant incremental movement for each engaged anode is known, the number of drive cycles necessary to position each of the anodes is readily determined. For example, assume that anodes 1, 4 and 6 need to be lowered 0.20, 0.40 and 0.08 inch (0.50, 1.0 and 0.20 cm), respectively, and assume that the incremental movement of the engaged anodes was 0.040 inch (0.10 cm) per drive cycle; the pneumatic clutches 36 for anodes 1, 4 and 6 would be engaged substantially simultaneously with the operation of the pneumatic drive 10. The drive mechanism 10 would be operated to rotate the shaft sections in the direction necessary to lower the engaged anodes. After the drive had accomplished two cycles, anode 6 would be in its proper position having been lowered two 0.040 inch (0.10 cm) increments. Therefore, after the second cycle, the clutch for anode 6 would be disengaged. Without interruption the drive mechanism would continue through three more cycles, a total of five cycles, at which time the clutch for anode 1 would disengage. The drive mechanism would continue uninterrupted operation through a total of ten cycles to assure that anode 4 is properly positioned. It should be understood that anode-cathode distance may be constantly monitored such that during the positioning of anodes 1, 4 and 6, as described above, it may become apparent that anode 8 needs lowered. The incremental drive system is preferably able to provide the slight intermittent time periods between drive increments that are necessary to engage additional anodes, such as anode 8, and accomplish additional repositioning without interruption of the drive mechanism 10.

All of the anodes in an electrolytic cell or any combination of such anodes can be incrementally positioned by the apparatus of the present invention. It will be understood that each engaged anode can be moved in only one direction when the drive mechanism is operating in one direction. For the engaged anode to move in the other direction, the drive mechanism must be operated in the other direction.

The importance of the operating speed of the positioning apparatus is apparent when considering that each drive cycle drives the anode a slight distance, such as merely 0.040 inch (0.10 cm), and the anodes must often be quickly moved several inches at a time. One example of when the anodes must be lowered several inches occurs when the aluminum is drawn or tapped from the pot which drastically changes the metal and the bath levels. Another major adjustment occurs as the amount of alumina consumed in the operation of the pot drops to about 2% and an anode effect occurs notifying the operator to add more alumina. The anode effect causes the voltage in the pot to rise suddenly to 30 volts or more. When the anode effect occurs, the anode may have to be quickly lowered approximately one inch. Also, each anode must also be raised as high as 18 inches (45.7 cm) in the event that a consumed anode must be changed, and a new anode substituted in its place.

In a preferred embodiment of the present invention, an auxiliary driving mechanism 20, such as an air operated motor, is provided to accommodate conditions in which the anode or a plurality of anodes must be repositioned several inches in a faster time than the incremental system permits. Such auxiliary motor 20 is designed to override the incremental drive mechanism 10 and continuously, rather than incrementally, rotate the shaft 12. Movement of the shaft 12 results in repositioning of one or a plurality of anodes through the same mechanical process as described above, the difference being continuous rather than incremental movement. It will be understood that the continuous auxiliary drive mechanism 20 does not provide the accurate measurement of anode location, as does the incremental drive mechanism 10, and for that reason the auxiliary drive should be used only as an alternative system to accomplish relatively quick anode repositioning over a relatively long length, such as several inches. As shown in FIG. 1, a plurality of overriding auxiliary drive mechanisms may be utilized. For example, one auxiliary drive may drive all of the anodes in one direction, while the second auxiliary drive may be used to position the anodes in the opposite direction. Alternatively, the auxiliary drive may be bidirectional, and used to drive the anodes in either direction.

Whereas, the particular embodiments of this invention have been described above for purposes of illustration, it will be apparent to those skilled in the art that numerous variations of the details may be made without departing from the invention.

What is claimed is:

1. An apparatus for positioning any number of a plurality of anodes with respect to a cathode in an electrolytic cell comprising:

drive means for incrementally rotating a substantially horizontally disposed shaft;

a plurality of jack screws substantially vertically disposed with respect to the shaft, each of said screws connected to an anode and provided with means therebetween for changing incremental rotary motion to incremental, vertically longitudinal, anode motion;

a plurality of worm gears each connected at its outer periphery to the shaft and connected at its inner periphery to an actuator nut disposed concentrically about said jack screw; and means for selectively engaging each actuator nut to its respective jack screw to rotate the jack screw incrementally in response to the incremental rotary movement of the shaft.

2. The apparatus as set forth in claim 1 wherein the drive means is pneumatically operated.

3. The apparatus as set forth in claim 1 wherein the engaging means is pneumatically operated.

4. The apparatus as set forth in claim 1 wherein the drive means is bidirectional.

5. An apparatus for positioning any number of a plurality of anodes with respect to a cathode in an electrolytic cell comprising:

means for substantially continuously determining the desired anode position for each of the plurality of anodes and converting the amount of movement necessary to attain such position to a number of increments of predetermined displacement;

pneumatic, bidirectional drive means for incrementally rotating a substantially horizontally disposed shaft;

a plurality of jack screws substantially vertically disposed with respect to the shaft, each of said screws connected to an anode and provided with means therebetween for converting incremental rotary motion to incremental, vertically longitudinal, anode motion;

a plurality of worm gears each connected at its outer periphery to the shaft and connected at its inner periphery to an actuator nut disposed concentrically about a top portion of said jack screw; and pneumatic means for selectively engaging each actuator nut to its respective jack screw to rotate the jack screw incrementally in response to the incremental rotary movement of the shaft, said engaging means responsive to the means for determining the desired anode position;

whereby each incremental rotation of the shaft in one direction displaces only the anodes integrally connected to the respective jack screws that are engaged with their respective actuator nuts a constant, downward, vertical distance, while incremental rotation of the shaft in the opposite direction displaces anodes connected to the respective engaged jack screws a constant, upward, vertical distance, to incrementally maintain all of the anodes in their respective, desired positions.

6. An apparatus as set forth in claim 5 further including an auxiliary, continuous drive mechanism for selectively overriding the bidirectional drive means to continuously rotate the shaft and displace the engaged anodes.

* * * * *